US007814868B2

(12) United States Patent
Yin et al.

(10) Patent No.: US 7,814,868 B2
(45) Date of Patent: Oct. 19, 2010

(54) FUEL-FIRED, POWER VENTED HIGH EFFICIENCY WATER HEATER APPARATUS

(75) Inventors: Jiang Yin, Montgomery, AL (US); Jozef Boros, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 427 days.

(21) Appl. No.: 12/038,406

(22) Filed: Feb. 27, 2008

(65) Prior Publication Data

US 2009/0211540 A1 Aug. 27, 2009

(51) Int. Cl.
*F22B 9/18* (2006.01)

(52) U.S. Cl. ..... 122/13.01; 122/44.2; 122/155.1

(58) Field of Classification Search ..... 122/13.01, 122/17.1, 44.2, 155.1
See application file for complete search history.

(56) References Cited

U.S. PATENT DOCUMENTS

| | | | | |
|---|---|---|---|---|
| 1,272,064 | A | 7/1918 | Lezius | |
| 1,991,557 | A | 2/1935 | Johnson | |
| 2,122,641 | A | 7/1938 | Frentzel, Jr. | |
| 3,490,420 | A | 1/1970 | Kramer | |
| 4,204,832 | A | 5/1980 | Miller | |
| 4,262,608 | A | 4/1981 | Jackson | |
| 4,269,166 | A | 5/1981 | Worley et al. | |
| 4,270,894 | A | 6/1981 | Moore, Jr. et al. | |
| 4,280,481 | A | 7/1981 | Fodor | |
| 4,292,950 | A | 10/1981 | Schossow | |
| 4,329,967 | A | 5/1982 | Levenberg | |
| 4,449,512 | A | 5/1984 | Hebert | |
| 4,509,499 | A | 4/1985 | Hebert | |
| 4,770,160 | A | 9/1988 | Schimmeyer | |
| 4,867,106 | A * | 9/1989 | Staats | 122/14.22 |
| 5,012,793 | A | 5/1991 | Guzorek | |
| 5,020,512 | A | 6/1991 | Vago et al. | |
| 5,090,445 | A | 2/1992 | Jackson | |
| 5,255,665 | A | 10/1993 | Windon | |
| RE34,534 | E | 2/1994 | Staats | |
| 5,375,651 | A | 12/1994 | Colwell | |
| 5,845,632 | A | 12/1998 | Schimmeyer | |
| 6,182,654 | B1 | 2/2001 | Jones | |
| 6,213,117 | B1 | 4/2001 | Kirk et al. | |
| 6,296,478 | B1 | 10/2001 | Gatley, Jr. | |
| 6,318,358 | B1 | 11/2001 | Gatley, Jr. | |
| 6,352,431 | B1 | 3/2002 | Gatley, Jr. | |
| 6,382,203 | B1 | 5/2002 | Kim et al. | |
| 6,398,512 | B2 * | 6/2002 | Stewart | 417/53 |
| 6,602,058 | B1 | 8/2003 | Stewart | |

(Continued)

*Primary Examiner*—Gregory A Wilson
(74) *Attorney, Agent, or Firm*—Haynes and Boone, LLP

(57) ABSTRACT

A fuel-fired water heater has a draft inducer fan assembly with a housing having an inlet for receiving hot combustion gases discharged from the water heater, and an outlet for discharging the combustion gases. A normally closed damper member within the housing is openable by fluid pressure force created by operation of a draft inducer fan portion of the assembly. With the damper in its open position the fan exhausts the received combustion gases through a housing outlet. When the damper closes it prevents convective outflow through the housing outlet of flue-heated air. In alternate embodiments of the assembly the fan is operative to also draw in dilution air that cools the fan motor and the discharged combustion gases, with the assembly having an internal configuration preventing convective outflow of flue-heated air through the housing dilution air inlet during standby periods of the water heater.

28 Claims, 9 Drawing Sheets

U.S. PATENT DOCUMENTS

| | | | | |
|---|---|---|---|---|
| 6,622,660 | B1 | 9/2003 | Bajic et al. | |
| 6,745,724 | B2 * | 6/2004 | Hughes et al. | 122/44.2 |
| 6,769,425 | B1 | 8/2004 | Kim | |
| 6,827,560 | B2 | 12/2004 | Gatley, Jr. et al. | |
| 6,868,806 | B1 | 3/2005 | Schimmeyer | |
| 6,948,454 | B2 * | 9/2005 | Hughes et al. | 122/44.2 |
| 6,951,241 | B1 | 10/2005 | Gatley | |
| 2002/0162517 | A1 | 11/2002 | Carlton et al. | |
| 2006/0070618 | A1 | 4/2006 | Schimmeyer | |
| 2009/0084328 | A1 * | 4/2009 | Lyons et al. | 122/13.01 |

* cited by examiner

CONTROLLER
29₃
20
26
26
26

FUEL-FIRED, POWER VENTED HIGH EFFICIENCY WATER HEATER APPARATUS

BACKGROUND OF THE INVENTION

The present invention generally relates to fuel-fired heating appliances and, in a representatively illustrated embodiment thereof, more particularly relates to a fuel-fired water heater having incorporated therein a specially designed draft inducer fan assembly that substantially reduces undesirable heat loss from the water heater during standby periods thereof, thereby desirably increasing the overall energy efficiency of the water heater.

In the area of fuel-fired water heaters a continuing design challenge is the reduction of heat loss from the water heater, which causes an undesirable lessening of the overall energy efficiency of the water heater, during idle or "standby" periods of the water heater. A substantial portion of the standby period heat loss from tank type water heaters occurs at the flue gas discharge area thereof. At such area, convective flows of flue-heated air rising from the water heater, or cold air downflows into the flue, can undesirably reduce the temperature of the tank-stored water, thereby correspondingly diminishing the overall energy efficiency of the water heater.

One conventionally utilized approach to lessening this flue discharge area heat loss is to place a motorized shutoff damper in the flue or in a discharge pipe connected thereto and control the damper in a manner such that it is motor-driven to an open position shortly prior to and during draft inducer fan operation and motor-driven to a closed position during idle periods of the fan corresponding to standby periods of the water heater. However, in various water heater applications, such as in the residential market, this addition of a motorized damper and associated controls to the water heater can increase the production cost of the water heater to an unacceptable extent.

From the foregoing it can be readily seen that a need exists for improved apparatus for lessening the flue gas discharge area heat loss of a fuel-fired water heater during standby periods thereof. It is to this need that the present invention is directed.

SUMMARY OF THE INVENTION

In carrying out principles of the present invention, in accordance with representatively illustrated embodiments thereof, a specially designed draft inducer fan assembly is provided and is representatively installed on a fuel-fired heating appliance, illustratively a water heater. During firing of the water heater it discharges hot combustion gases through a flue portion of the water heater.

In an exemplary embodiment thereof, the draft inducer fan assembly comprises a housing having an internal wall structure dividing its interior into first and second chambers communicating with one another through an opening in the internal wall structure. The first chamber has an inlet area communicating with the flue to receive hot combustion gases therefrom, the housing further having an outlet area through which the received hot combustion gases may exit the housing. The assembly further comprises a draft inducer fan associated with the housing and operative to sequentially flow the received hot combustion gases from the first chamber through the internal wall structure opening into the second chamber and then outwardly from the housing through the outlet area. A damper portion of the assembly is movable, by fluid pressure force created by operation of the draft inducer fan, from a normally closed position thereof in which the damper substantially prevents gas flow between the housing inlet and outlet areas, to an open position in which the damper permits gas flow between the housing inlet and outlet areas. The damper preclusion of gas flow between the housing inlet and outlet areas substantially prevents convective flow of flue-heated air through the housing during non-firing "standby" periods of the water heater, thereby desirably increasing the overall energy efficiency of the water heater.

Illustratively, the internal wall structure opening is an orifice opening sized and configured to optimize selected operational parameters (such as, for example, draft inducer fan characteristics, flue gas temperature and $CO_2$ percentage) and impede gas flow therethrough from the first chamber into the second chamber as well, and the draft inducer fan has an impeller portion with an inlet communicating with the second chamber. The damper is representatively a gravity damper pivotally carried within the housing for movement between the damper's normally closed and open positions. In one exemplary version thereof the gravity damper, when in its normally closed position, blockingly extends across at least one of the first and second chambers. In another exemplary version thereof the gravity damper, when in its normally closed position, blocks the internal wall structure opening.

In an alternate exemplary embodiment of the draft inducer fan assembly, its housing portion has a dilution air inlet for receiving dilution air from an external source thereof, and the internal wall structure is configured to permit the received dilution air to flow into the second chamber through the wall structure opening when the damper is in its open position. The draft inducer fan has a motor disposed in an interior portion of the housing and is positioned to be impinged upon and cooled by incoming dilution air, the interior portion of the housing communicating with the first chamber therein.

In another exemplary embodiment of the draft inducer fan assembly its internal housing wall structure opening is a first opening, and the internal wall structure further divides the interior of the housing into a third chamber separated from the first chamber and communicating with the second chamber through a second opening in the internal wall structure the housing has a dilution air inlet through which dilution air from an external source thereof may flow into the third chamber for transfer therefrom into the second chamber via the second opening. The damper blocks the first and second openings when the damper is in its normally closed position, and uncovers the first and second openings when the damper is in its open position. The draft inducer fan has a motor disposed within the third chamber and positioned to be impinged upon and cooled by incoming dilution air. In this exemplary embodiment of the draft inducer fan assembly the housing has an internal wall portion that cooperates with the damper, when it is in its normally closed position during standby periods of the water heater, to substantially prevent convective flow of flue-heated air outwardly through either the combustion gas outlet of the housing or its dilution air inlet.

According to other aspects of the invention, in various exemplary embodiments thereof, the draft inducer fan is operative to exert oppositely directed fluid pressure forces on the damper to move it from its normally closed position to its open position thereof, and the assembly may further comprise damper stop structure operative to blockingly and sealingly engage the damper when the damper is in its normally closed position, sealing enhancement apparatus, connected to the damper, for forcing it against the damper stop structure when the damper is in its normally closed position.

DETAILED DESCRIPTION

Figure 1:
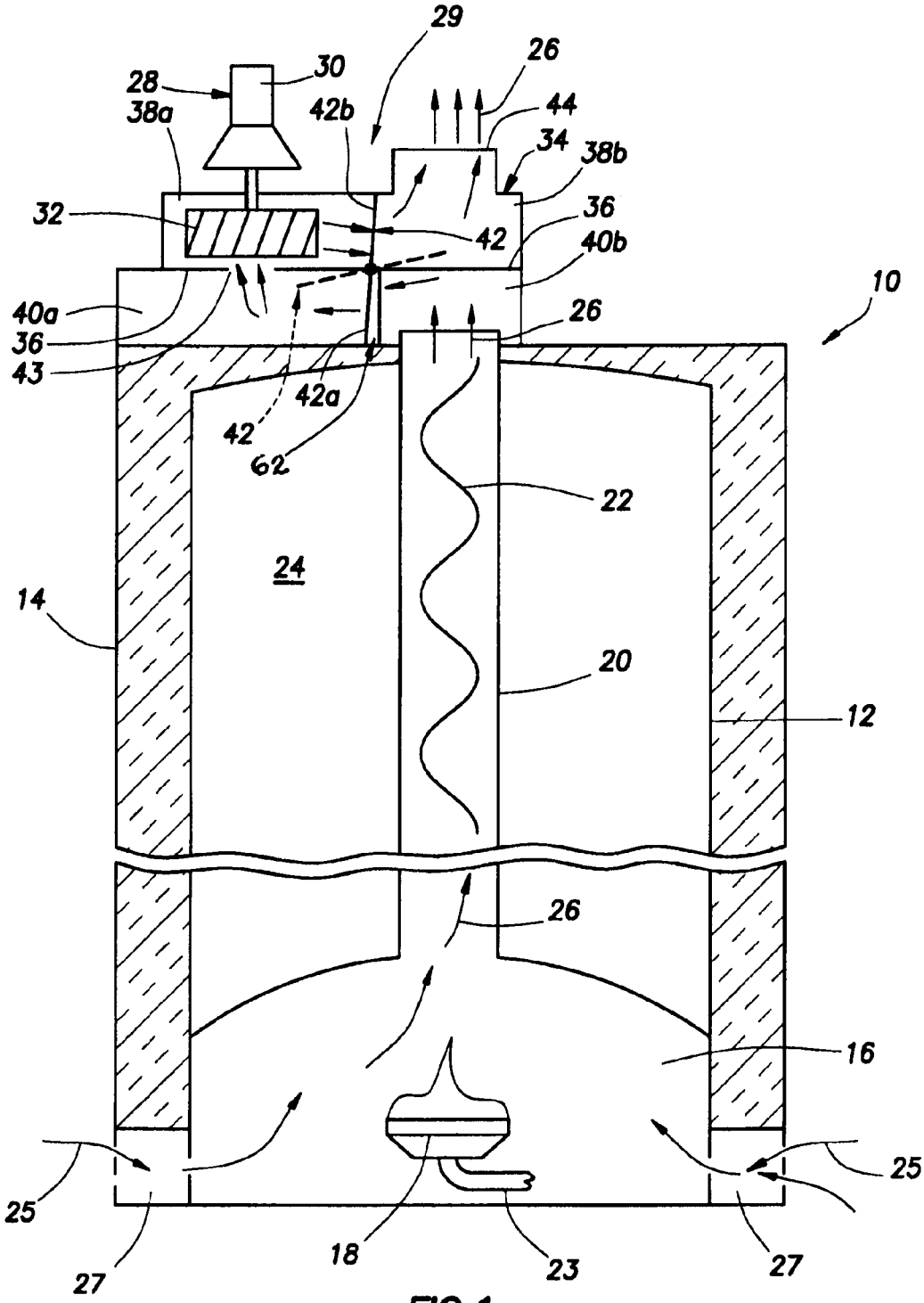
FIG. 1 is a vertically foreshortened schematic cross-sectional view through a fuel-fired water heater upon which is operatively mounted a first exemplary embodiment of a specially designed draft inducer fan assembly embodying principles of the present invention.

Schematically depicted in FIG. 1 is a fuel-fired, power vented water heater 10 having the usual hot water storage tank 12, insulated outer jacket structure 14, combustion chamber 16, burner 18 and flue 20 with a baffle 22 therein to increase the efficiency of combustion heat transfer from the flue 20 to water 24 stored in the tank 12. In a conventional manner, the burner 18 is supplied with fuel from a source thereof via a valved supply line 23.

During firing of the water heater 10, and entry of combustion air 25 into the combustion chamber 16 through suitable side wall openings 27 thereof, hot combustion products 26 created by burner 18 within combustion chamber 16 are drawn upwardly through the flue 20 by the operation of a draft inducer fan 28 forming a portion of a specially designed draft inducer fan assembly 29 embodying principles of the present invention. Draft inducer fan 28 has a motor 30 and an impeller 32 driven by the motor 30. Disposed above the open upper end of the flue 20, and also forming a portion of the overall draft inducer fan assembly 29 is a fan assembly housing 34 which is vertically divided by an internal horizontal plate 36 into upper and lower chambers 38 and 40.

Figure 2:
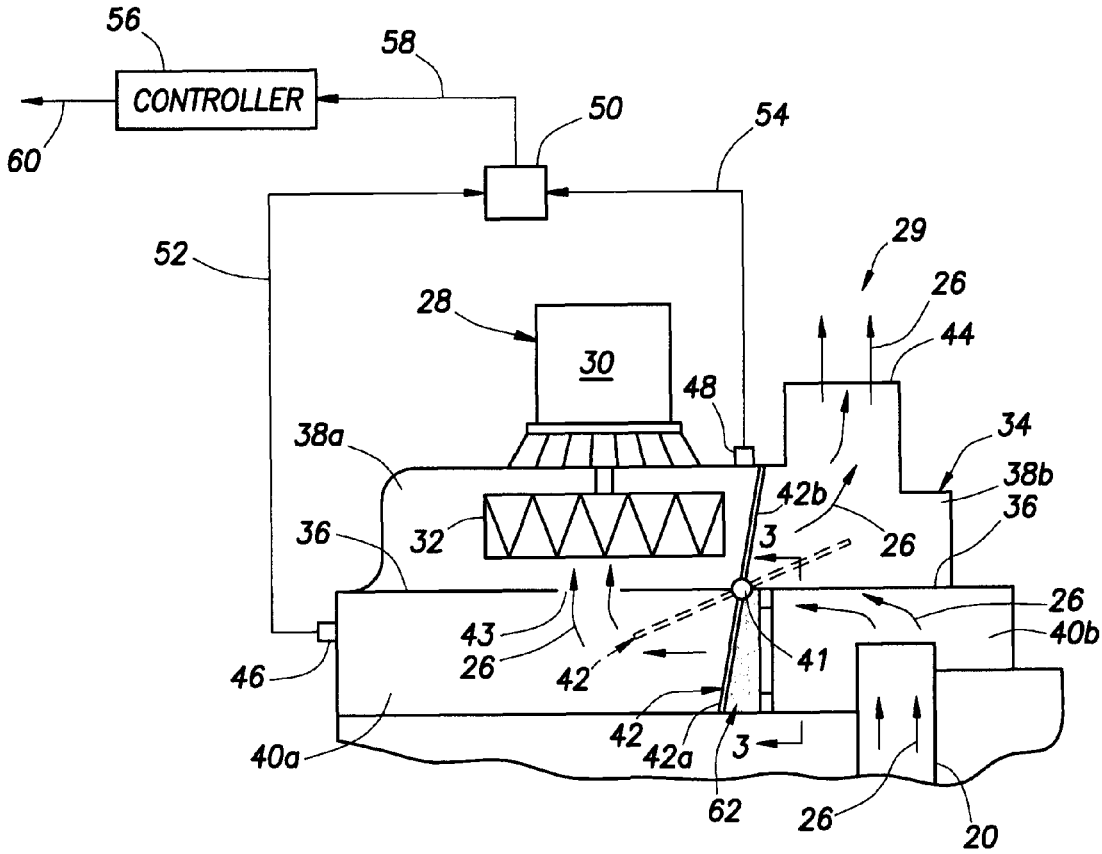
FIG. 2 is an enlarged scale cross-sectional view of the draft inducer fan assembly.

With reference now to FIGS. 1 and 2, a gravity damper 42 is pivotally connected, as at 41, to the plate 36 and, when in its normally closed, vertically oriented solid line position with the fan 28 not operating, divides the upper and lower chambers 38,40 into the illustrated subchambers 38*a*,38*b* and 40*a*, 40*b*. The fan impeller 32 is rotationally disposed within the subchamber 38*a* which communicates with the underlying subchamber 40*a* via an opening 43 in the plate 36. As illustrated, the open upper end of the flue 20 communicates with the subchamber 40*b*, and a flue gas outlet opening 44 is formed in the top side of the subchamber 38*b*. Representatively, the opening 43 is an orifice opening sized and configured to optimize selected operational parameters (such as, for example, draft inducer fan characteristics, flue gas temperature and $CO_2$ percentage) and throttle gas flow therethrough from subchamber 40*a* into the subchamber 38*a* as well, thereby desirably slowing the upward flow of combustion gases 26 through the flue 20.

During firing of the water heater 10, and operation of the draft inducer fan 28, the fan 28 causes the gravity damper 42 to pivot in a clockwise direction from its solid line closed position to its dotted line open position to thereby communicate the subchambers 38*a* and 38*b* and also communicate the subchambers 40*a* and 40*b* as shown. It should be noted that the fan 28 exerts a "push-pull" combination of rotational forces on the damper 42, with the inlet side of the fan creating a clockwise rotational "pulling" force on a lower portion 42*a* of the damper blade, and the outlet side of the fan creating a clockwise rotational "pushing" force on an upper portion 42*b* the damper blade. As compared to an installation in which the damper 42 extended across only one of the chambers 38,40 instead of both of them as shown, this permits the damper 42 to have a larger blade area and thus an advantageously larger overall available peripheral sealing area. Additionally, the "push-pull" torque exerted on the damper 42 enables it to be opened to a wider angle, and overcome higher frictional forces thereon. With the damper 42 opened by fan-created flow forces, combustion gases 26 exiting the open upper end of the flue 22 sequentially pass through the subchambers 40*b*, 40*a*, 38*a* and 38*b* before being discharged from the fan assembly housing 34 via the flue gas outlet opening 44 therein.

When firing and fan operations cease, the gravity damper 42 automatically pivots back to its normal solid line position to thereby seal off the interior of the housing 34, in a manner subsequently described herein, to substantially hinder upward convection heat flow from rising therethrough or cold air from falling downwardly therethrough. Because of the unique configuration and operation of the draft inducer fan assembly 29 of the illustrated water heater 10, the overall energy efficiency of the water heater is substantially improved by reducing heat loss therefrom during standby periods thereof. Water heater 10 is representatively of a "non-dilution" type, meaning that the combustion gases 26 are discharged therefrom without first mixing the combustion gases 26 with a flow of cooling or "dilution" air.

With reference to FIG. 2, suitable pressure taps 46,48 are respectively communicated with the interiors of the housing subchamber 40*a* upstream of the fan 28 and the housing subchamber 38*a* between the fan impeller 32 and the upper damper blade portion 42*b*. Pressure taps 46,48 are respectively coupled to a pressure differential switch 50 by pressure leads 52 and 54. During operation of the fan 28, the pressure differential switch 50 outputs to a controller 56 a signal 58 indicative of the sensed pressure differential across the fan 28.

Controller 56 responsively outputs a control signal 60 that may be utilized to control one or more selected operational aspects of the water heater 10. For example, when the sensed pressure difference across the fan 28 in the beginning, and during operation thereof, is not within a predetermined range, the control signal may indicate that the damper 42 is stuck in a closed position, or incorrect operation of the fan 28, and may be used to shut down the operation of the water heater 10.

Figure 2A:
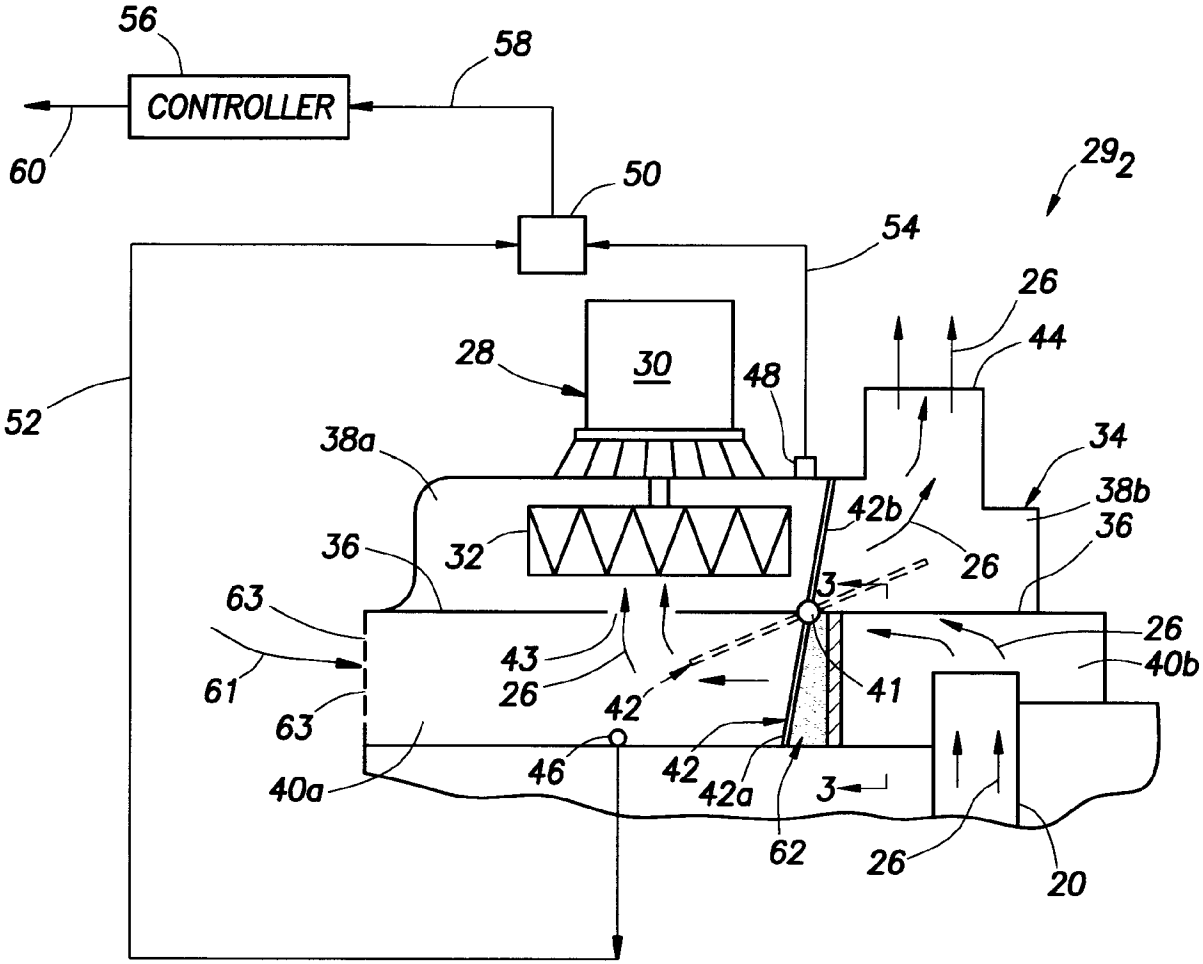
FIG. 2A is a schematic cross-sectional view through a second exemplary embodiment of the draft inducer fan assembly.

A second exemplary embodiment $\mathbf{29}_2$ of the previously described draft inducer fan assembly 29 is schematically shown in FIG. 2A. With the two exceptions noted below, the fan assembly $\mathbf{29}_2$ is identical to the previously described fan assembly 29. For ready comparison of the two fan assemblies 29 and $\mathbf{29}_2$, identical or substantially similar components in the two fan assembly embodiments have been given identical reference numerals.

The first difference between the fan assemblies 29 and $\mathbf{29}_2$ is that, in the fan assembly $\mathbf{29}_2$, during firing of the water heater 10, and operation of the draft inducer fan 28, ambient dilution air 61 is drawn into the housing subchamber 40*a*, via dilution air openings 63 in the side wall of the housing 34, for mixing with and cooling of the hot combustion products 26 entering the subchamber 38*a* via the opening 43. The second difference between the fan assemblies 29 and $\mathbf{29}_2$ is that in the assembly $\mathbf{29}_2$ the pressure tap 46 is relocated as shown in FIG. 2A.

Figure 3:
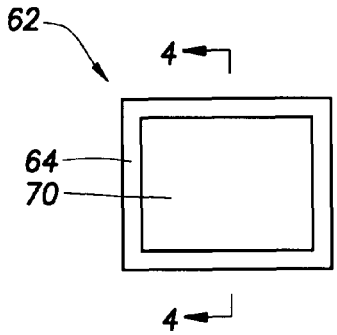
FIG. 3 is an enlarged scale schematic cross-sectional view, taken along line 3-3 of FIG. 2, through the draft inducer fan assembly and illustrating a damper stop/gasket structure disposed therein.
Figure 4:
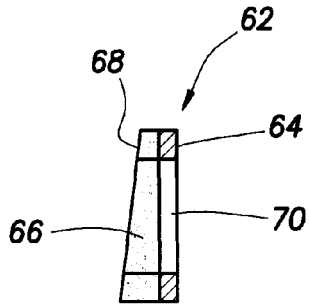
FIG. 4 is a cross-sectional view through the damper stop gasket structure taken along line 4-4 of FIG. 3.

With reference now to FIGS. 2-4, when the gravity damper 42 (in either FIG. 2 or FIG. 2A) is in its generally vertical solid line closed position, the lower portion 42*a* of the damper blade rightwardly seals against a damper stop/gasket structure 62 interiorly secured within the chamber 40 to the right of the lower damper portion 42*a*. The damper stop/gasket structure 62 has a hollow rectangular metal frame section 64 on the left face of which a resilient sealing gasket material 66 is suitably secured, the gasket material 66 having an inclined outer sealing surface 68 contacted by the lower damper portion 42*a* when the damper 42 is in its closed position. During operation of the fan 28, hot combustion gases 26 flow through the central opening 70 of the damper stop/gasket structure 62 (see FIGS. 3 and 4). While the damper stop/gasket structure 62 has been representatively shown as being installed in the bottom fan housing chamber 40, it will be readily appreciated by those of skill in this particular art that it could be alternatively positioned in the upper chamber 38 to be sealingly contacted by the upper damper portion 42*b*. As will be readily appreciated, the shape of the damper stop/gasket structure 62 may be varied in accordance with different blower inner gas passage designs and specific applications without departing from principles of the present invention.

Figure 5:
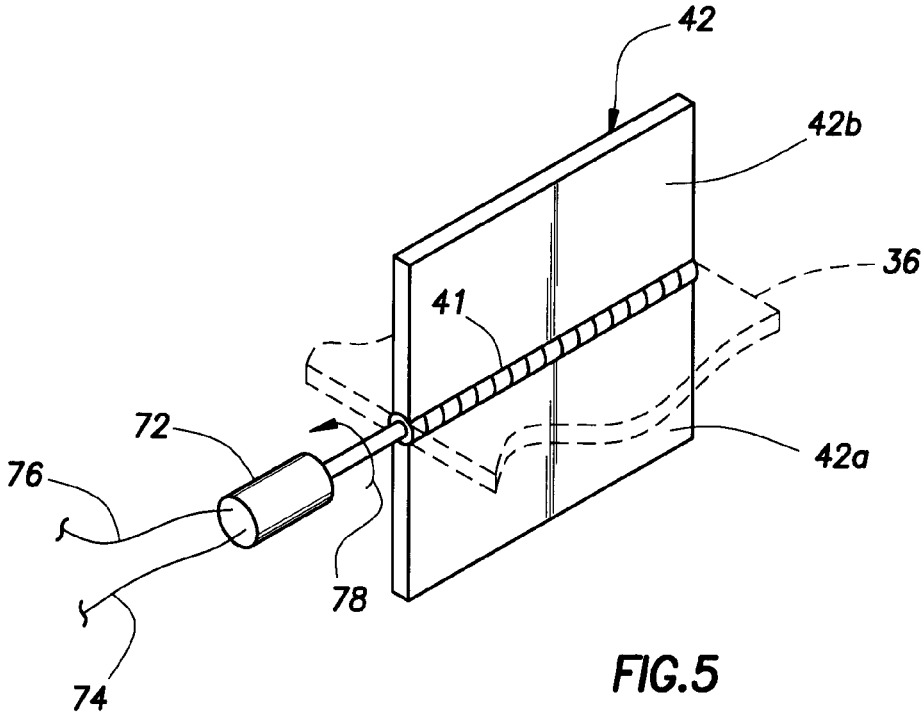
FIG. 5 is a schematic perspective view of a first alternate embodiment of a damper structure portion of the draft inducer fan assembly.

As previously mentioned, the damper 42 is a gravity type damper, with the weight of the damper being balanced in a manner such that it exerts a sealing force on the gasket material 66 when the damper is in its closed position. Such sealing force may be increased, using sealing enhancement apparatus as will now be described, by drivingly coupling a small electric closure motor 72 to the damper 42 as schematically depicted in FIG. 5. Upon sensing termination of operation of the fan 28, the control system of the water heater 10, via electrical leads 74 and 76, energizes the motor 72 in a manner causing it to exert a rotational force 78 on the damper 42 which mechanically presses its lower portion 42*a* against the gasket material 66. Upon a call for heat initiated by a thermostat (not shown) of the water heater, the motor 72 is de-energized to permit opening of the damper 42 before energization of the fan 28.

Figure 6:
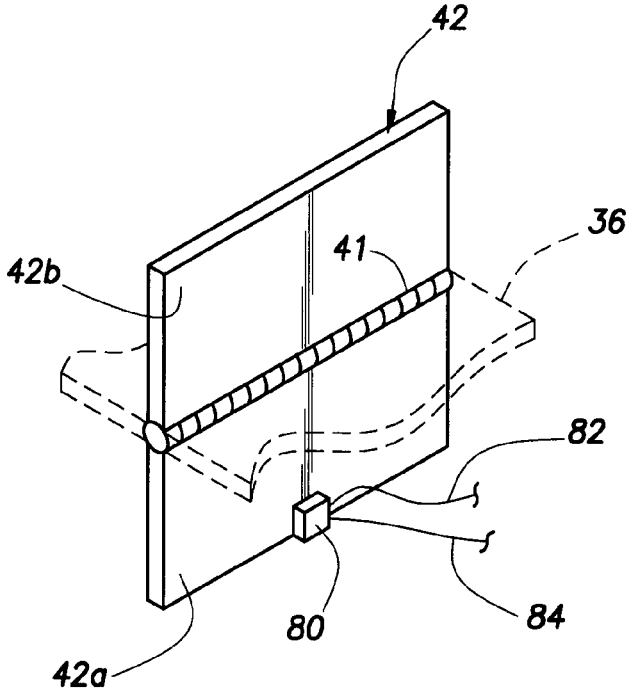
FIG. 6 is a schematic perspective view of a second alternate embodiment of the damper structure portion of the draft inducer fan assembly.

Alternatively, using another sealing enhancement apparatus embodiment as schematically shown in FIG. 6, the lower damper portion 42*a* may be magnetically pressed against the gasket material 66 when the damper 42 is in its closed position during non-operational periods of the fan 28. This may be achieved by placing a small electromagnet 80 on the lower damper portion 42*a* and energizing the electromagnet 80, via electrical leads 82 and 84, to thus cause the electromagnet 80 to be attracted to a suitably positioned metal structure (such as a portion of the frame 64) and force the bottom damper portion 42 against the gasket material 66. Before energization of the fan 28, the electromagnet 80 may also be de-energized to permit the damper 42 to be pivoted to its open position by fluid forces generated by the fan 28 as previously described herein.

As can be seen from the foregoing, using principles of the present invention undesirable heat loss from the water heater 10 during standby periods thereof is substantially reduced by the damper stop/gasket structure 62 sealingly contacted by the damper 42 in it closed position.

Figure 7:
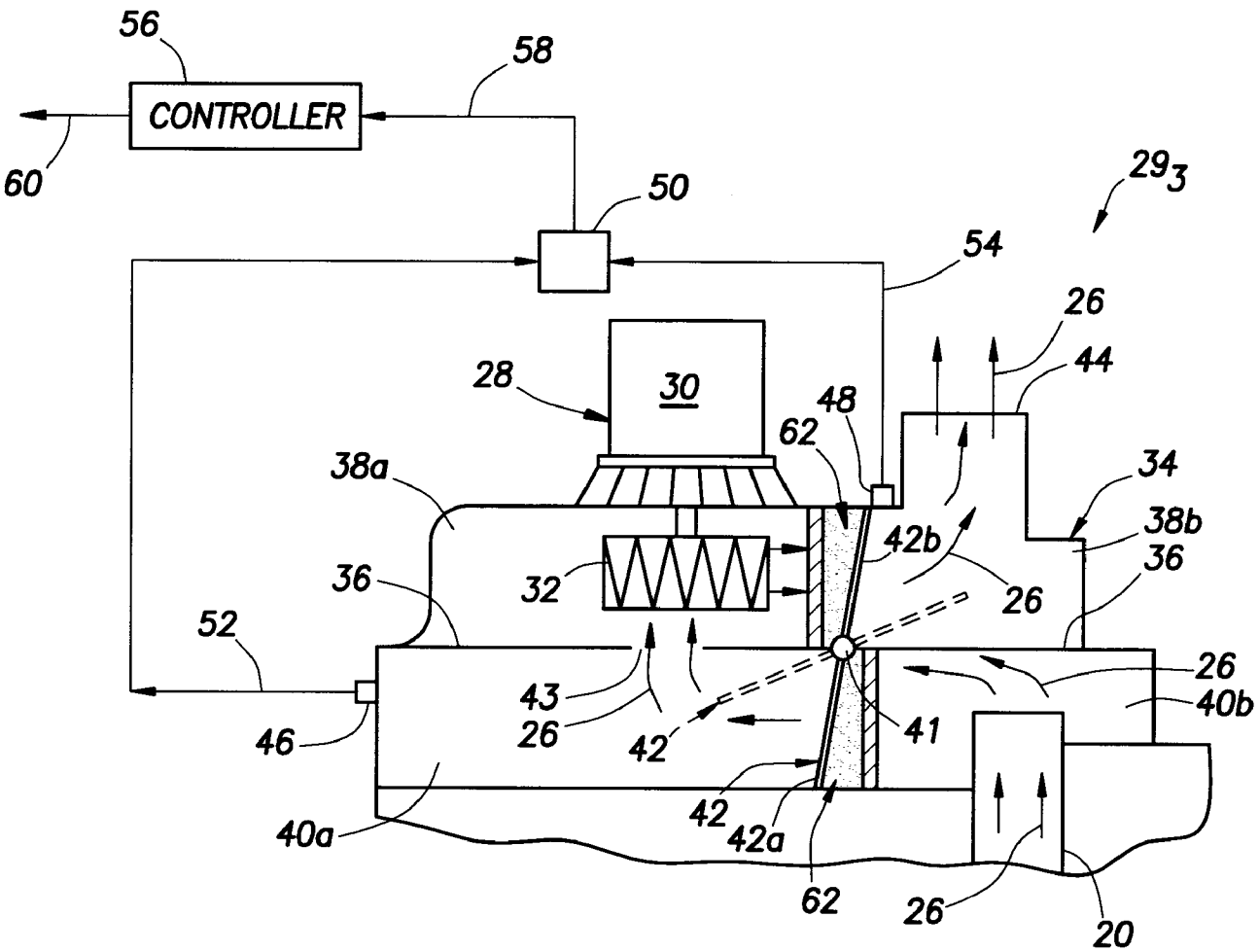
FIG. 7 is a schematic cross-sectional view taken through a third exemplary embodiment of the draft inducer fan assembly.

A third exemplary embodiment $\mathbf{29}_3$ of the previously described draft inducer fan assembly 29 is schematically shown in FIG. 7. With the exception noted below, the fan assembly $\mathbf{29}_3$ is identical to the previously described fan assembly 29. For ready comparison of the two fan assemblies 29 and $\mathbf{29}_3$, identical or substantially similar components in the two fan assembly embodiments have been given identical reference numerals.

The difference between the fan assemblies 29 and $\mathbf{29}_3$ is that in the assembly $\mathbf{29}_3$ an additional damper stop/gasket structure 62 is operatively installed in the upper chamber 38 in a manner such that when the damper 42 is in its closed position its lower portion 42*a* sealingly engages the gasket material on the lower damper stop/gasket structure 62, and its upper portion 42*b* sealingly engages the gasket material on the upper damper stop/gasket structure 62. Thus, during standby periods of the water heater 10 undesirable upward convective heat flow from the flue through the housing 34, and downward flow of cold air therethrough, are substantially prevented by two separate seal structures operatively associated with the fan pressure-driven oversized damper 42. As in the case of the previously described fan assembly 29, the closing and sealing force of the gravity damper 42 in the assembly $\mathbf{29}_3$ may be augmented by the addition thereto of the previously discussed sealing enhancement structure shown in FIG. 5 or FIG. 6.

Figure 8:
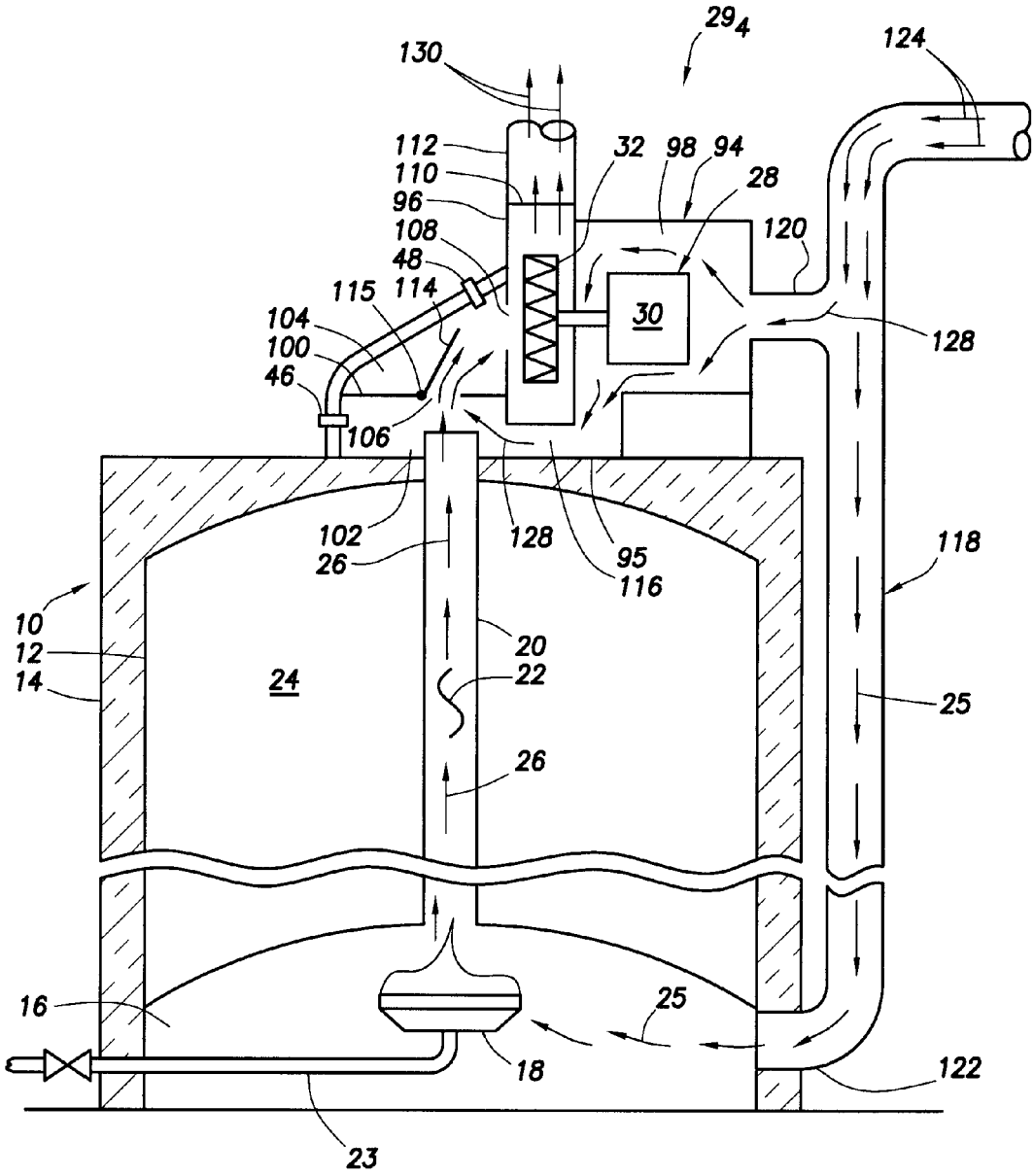
FIG. 8 is a vertically foreshortened schematic cross-sectional view through a fuel-fired water heater upon which is operatively mounted a fourth exemplary embodiment of the draft inducer fan assembly.

Schematically depicted in FIG. 8 is a fourth exemplary embodiment $\mathbf{29}_4$ of the previously described draft inducer fan assembly 29. Assembly $\mathbf{29}_4$ is operatively mounted on top of the previously described water heater 10, over the open upper end of its flue 20, and has a blower assembly housing 94 with an open bottom side that overlies the open upper end of the flue 20. Extending downwardly through a horizontally central portion of the assembly housing 94 into its interior is a fan impeller housing 96 in which the fan impeller 32 is rotatably disposed. As illustrated, the fan motor 30 is positioned to the right of the impeller housing 96 and is disposed within a dilution air receiving chamber portion 98 of the assembly housing 94.

A horizontal dividing wall 100 within the interior of the assembly housing 94 vertically divides a left interior portion thereof into a flue gas receiving chamber 102 disposed beneath the dividing wall 100, and a mixing chamber 104 disposed above the dividing wall 100 and bounded on its right side by the fan impeller housing 96. Chamber 102 communicates with the chamber 104 via a transfer opening 106 in the dividing wall 100, and chamber 104 communicates with the interior of the fan impeller housing 96 via an inlet opening 108 therein. Impeller housing 96 has a top side outlet 110 that is coupled to a suitable discharge conduit 112. A gravity damper 114 is pivotally connected, as at 115, to the dividing wall 100, and is shown in its raised, open position. In its normally closed position the damper 114 falls to a horizontal position in which it overlies and blocks the transfer opening 106. The flue gas receiving chamber 102 communicates with the dilution air chamber 98 via a passage 116 beneath the lower side of the fan impeller housing 96.

With continuing reference to FIG. 8, an external air supply conduit 118 extends downwardly along a right side portion of the water heater 10 and has an upper outlet branch 120 communicating with the dilution air chamber 98, and a lower outlet branch 122 communicating with the combustion chamber 16. During firing of the water heater 10 and operation of the draft inducer fan 28, the suction force of the fan 28 opens the damper 14 and sequentially draws hot burner-generated combustion gases 26 upwardly through the flue 20 into the flue gas receiving chamber 102, into the mixing chamber 104 and then into the fan impeller housing 96 through its side wall opening 108. At the same time, the draft inducer fan 98 causes ambient air 124 from outside the water heater 10 to flow inwardly through an upper end portion of the air supply conduit 118.

A first portion of the incoming air 124 flows through the upper outlet branch 120 into the chamber 98 as dilution air 128 which flows externally around and cools the fan motor 30 within the chamber 98. The dilution air 128 then passes into the chamber 104, via the passage 116, and then enters the chamber 104 through the transfer opening 106. Next, together with combustion gases 26 within the chamber 104, the dilution air 128 enters the fan impeller housing 96 wherein it cools the combustion gases 26 such that they exit the fan impeller housing 96 as cooled combustion gases 130. The remainder of the incoming ambient air 124 continues downwardly through the air supply conduit 118 as combustion air 25 which flows into the combustion chamber 16 via the lower outlet branch 122 of the air supply conduit 118.

When firing of the water heater 10 ceases, and the draft inducer fan 28 then shuts down, the gravity damper 114 downwardly pivots to its normally closed position in which it blocks the transfer opening 106, thereby preventing convective upflows from the flue 20 from escaping from the system via the fan housing 96 during standby periods of the water heater 10 and desirably reducing standby heat losses therefrom. Such automatic closure of the damper 114, which was previously opened by fluid forces of the fan 28, also blocks further flow of ambient air 124 through the fan assembly $\mathbf{29}_4$ and the combustion chamber 16. As with the previously described exemplary embodiments of the draft inducer fan assembly, the fan assembly $\mathbf{29}_4$ is provided with the indicated pressure taps 46,48 which may be utilized to sense the pressure differential between the chambers 102 and 104 as previously described in conjunction with the chambers 38*a*,40*a* shown in FIG. 2.

Figure 9:
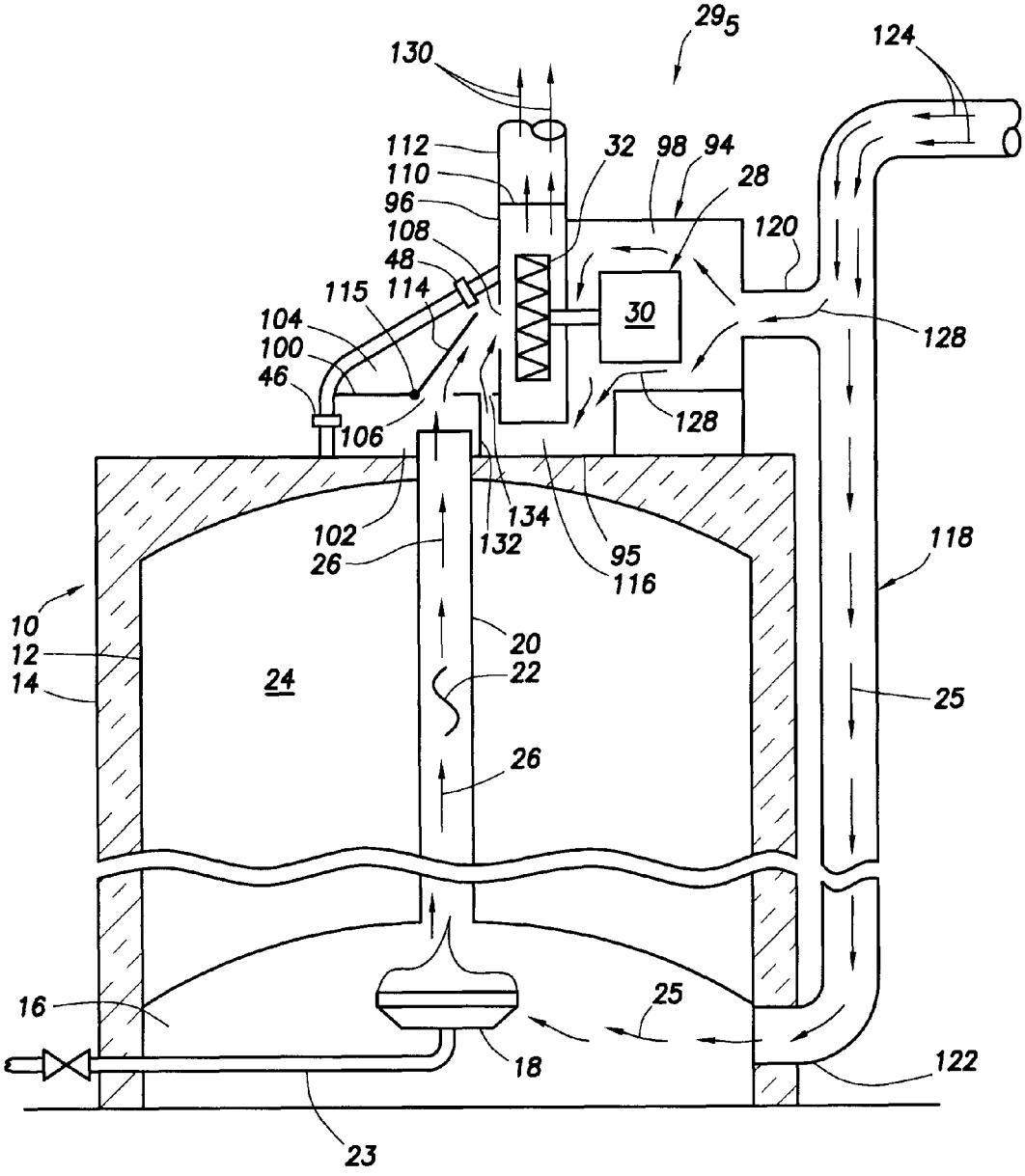
FIG. 9 is a vertically foreshortened schematic cross-sectional view through a fuel-fired water heater upon which is operatively mounted a fifth exemplary embodiment of the draft inducer fan assembly.

A fifth exemplary draft inducer fan assembly embodiment $\mathbf{29}_5$ is schematically depicted in FIG. 9 and is shown operatively connected to the water heater 10 over the open upper end of its flue 20. With the exceptions noted below, the assembly $\mathbf{29}_5$ is identical in structure and operation to the previously described draft inducer fan assembly $\mathbf{29}_4$ shown in FIG. 8. For ready comparison of the two fan assemblies $\mathbf{29}_4$ and $\mathbf{29}_5$, identical or substantially similar components in the two fan assembly embodiments have been given identical reference numerals.

A first difference between the draft inducer fan assemblies $\mathbf{29}_4$ and $\mathbf{29}_5$ is that in the assembly $\mathbf{29}_5$ the chambers 102 and 98 are separated from one another by a vertical dividing wall 132 extending downwardly from the horizontal dividing wall 100 to the top end of the water heater 10 and horizontally disposed between the open upper end of the flue 20 and a lower side portion of the fan impeller housing 96. A second difference between the draft inducer fan assemblies $\mathbf{29}_4$ and $\mathbf{29}_5$ is that in the assembly $\mathbf{29}_5$ an additional transfer opening 134 is formed in the horizontal dividing wall 100 between the vertical dividing wall 132 and the fan impeller housing 96. Chamber 102 communicates with the chamber 104 through the transfer opening 106, and chamber 98 communicates with the chamber 104 through the transfer opening 134. A third difference between the draft inducer fan assemblies $\mathbf{29}_4$ and $\mathbf{29}_5$ is that in the assembly $\mathbf{29}_5$ the gravity damper 114 is sized in a manner such that when it is downwardly pivoted to its normally closed position it blocks both of the transfer openings 106 and 134.

With continuing reference to FIG. 9, during firing of the water heater 10 and operation of the draft inducer fan 28, the suction of the fan 28 raises the damper 114 to its indicated open position, hot combustion gases 26 are drawn into the chamber 104 through the transfer opening 106, and dilution air 128 is drawn into the chamber 104 through the second transfer opening 134 for mixing with the entering combustion gases 26 and flow through the draft inducer fan 28. When the firing of the water heater 10 and operation of the draft inducer fan 28 cease, the damper 114 pivots downwardly to its normally closed position and blocks both of the transfer openings 106 and 134.

During standby periods of the water heater 10 the closed damper 114 prevents convective heat migration from the flue 20 into the chamber 104 and then outwardly through the draft inducer fan 28, and the vertical dividing wall 132 prevents such convective heat migration from the flue 20 into and outwardly through the air supply conduit 118 via the dilution air chamber 98. The use of separate transfer openings 106,134 to permit inflows of combustion gases 26 and dilution air 128, respectively, into the chamber 104 during operation of the draft inducer fan 28 and firing of the water heater 10 permits the flow rate of such inflows to be separately regulated by appropriately sizing the relative areas of the transfer openings 106 and 134.

Figure 10:
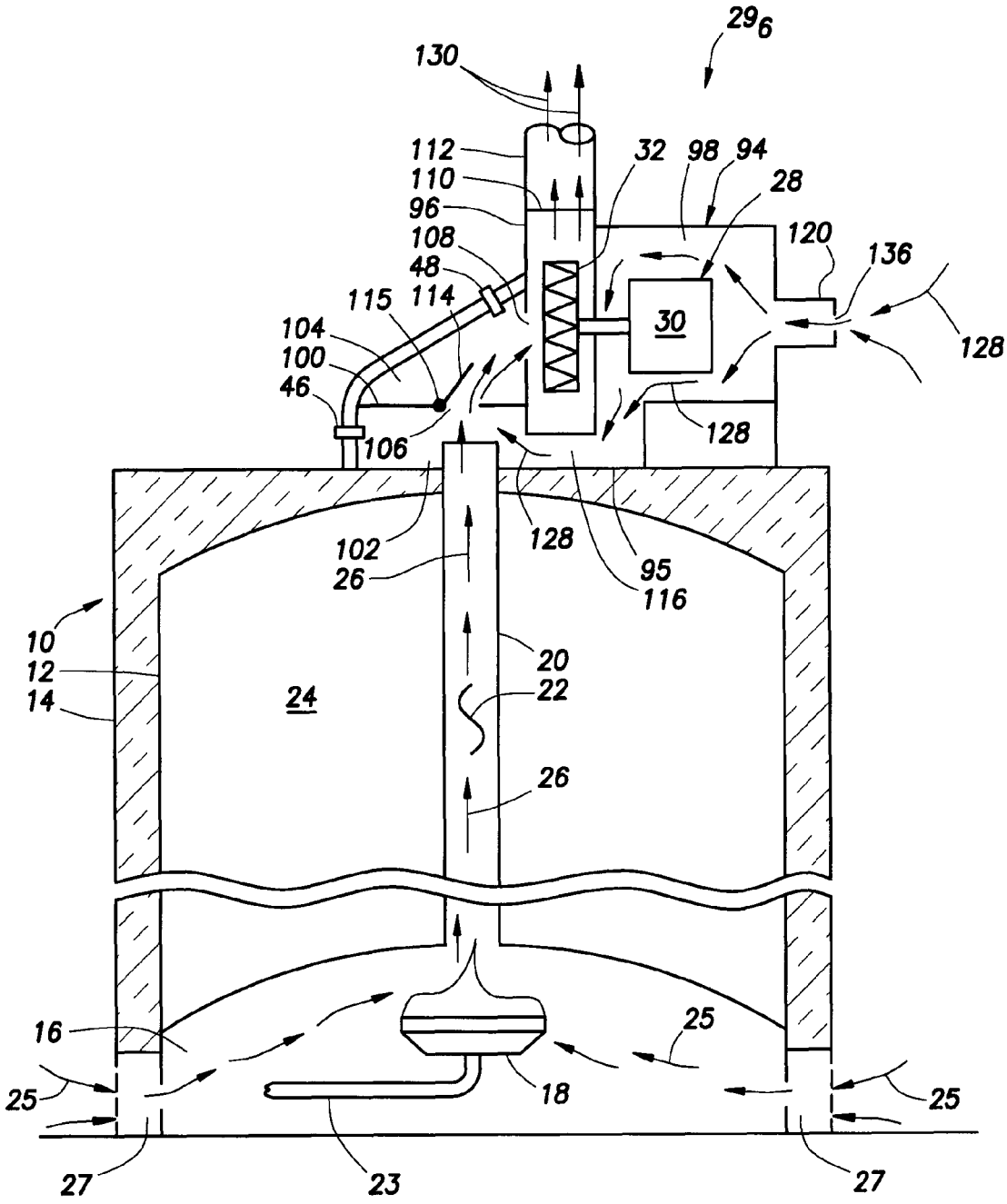
FIG. 10 is a vertically foreshortened schematic cross-sectional view through a fuel-fired water heater upon which is operatively mounted a sixth exemplary embodiment of the draft inducer fan assembly.

A sixth exemplary draft inducer fan assembly embodiment $\mathbf{29}_6$ is schematically depicted in FIG. 10 and is shown operatively connected to the water heater 10 over the open upper end of its flue 20. With the exceptions noted below, the assembly $\mathbf{29}_6$ is identical in structure and operation to the previously described draft inducer fan assembly $\mathbf{29}_4$ shown in FIG. 8. For ready comparison of the two fan assemblies $\mathbf{29}_6$ and $\mathbf{29}_4$, identical or substantially similar components in the two fan assembly embodiments have been given identical reference numerals.

In the draft inducer fan assembly $\mathbf{29}_6$, the air supply conduit 128 shown in FIG. 8 is eliminated, and combustion air inlet openings 27 are formed in the water heater 10 underlying the draft inducer fan assembly $\mathbf{29}_6$. During firing of the water heater 10, and operation of the draft inducer fan 28 of the assembly $\mathbf{29}_6$ dilution air 128 from adjacent the water heater 10 is drawn inwardly into the dilution air chamber 98 through an inlet opening 136 formed, for example, in the duct 120. Additionally, combustion air 25 adjacent the water heater is drawn into the combustion chamber 16 via side wall openings 27 therein. As can be seen, the water heater 10 shown in FIG. 8 is a powered direct vent water heater, while the water heater 10 shown in FIG. 10 is a power vented water heater which receives dilution and combustion air from adjacent the water heater as opposed to receiving such combustion and dilution air from a location remote from the water heater.

Figure 11:
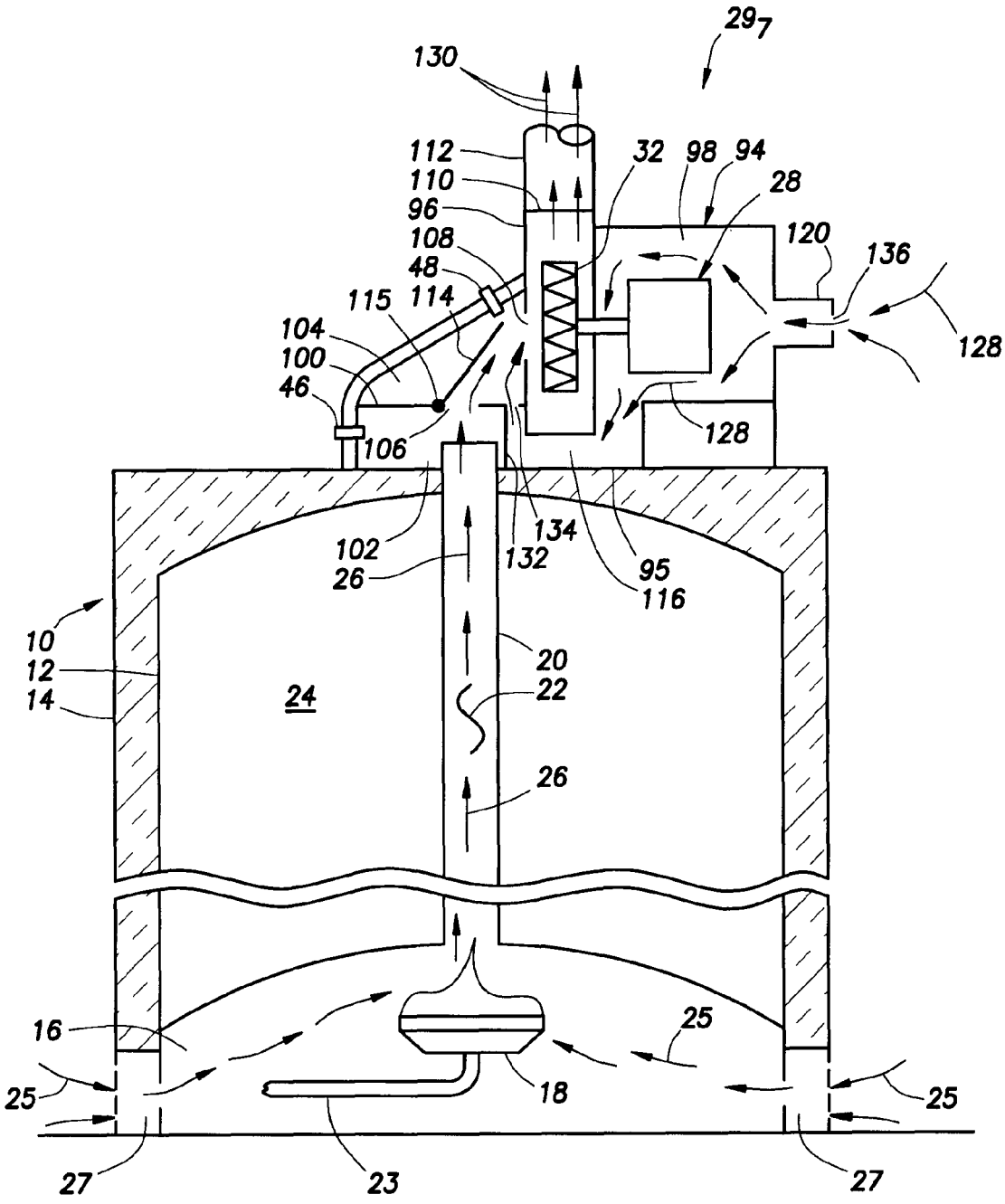
FIG. 11 is a vertically foreshortened schematic cross-sectional view through a fuel-fired water heater upon which is operatively mounted a seventh exemplary embodiment of the draft inducer fan assembly.

A seventh exemplary draft inducer fan assembly embodiment $29_7$ is schematically depicted in FIG. 11 and is shown operatively connected to the water heater 10 over the open upper end of its flue 20. With the exceptions noted below, the assembly $29_7$ is identical in structure and operation to the previously described draft inducer fan assembly $29_5$ shown in FIG. 9. For ready comparison of the two fan assemblies $29_7$ and $29_5$, identical or substantially similar components in the two fan assembly embodiments have been given identical reference numerals.

In the draft inducer fan assembly $29_7$, the air supply conduit 128 shown in FIG. 8 is eliminated, and combustion air inlet openings 27 are formed in the water heater 10 underlying the draft inducer fan assembly $29_7$. During firing of the water heater 10, and operation of the draft inducer fan 28 of the assembly $29_7$ dilution air 128 from adjacent the water heater 10 is drawn inwardly into the dilution air chamber 98 through an inlet opening 136 formed, for example, in the duct 120. Additionally, combustion air 25 adjacent the water heater is drawn into the combustion chamber 16 via side wall openings 27 therein. As can be seen, the water heater 10 shown in FIG. 9 is a powered direct vent water heater, while the water heater 10 shown in FIG. 11 is a power vented water heater which receives dilution and combustion air from adjacent the water heater as opposed to receiving such combustion and dilution air from a location remote from the water heater.

As can be seen from the foregoing, each of the exemplary draft inducer fan assemblies 29-$29_7$ desirably limits the standby heat loss of its associated water heater 10 using a shutoff damper structure driven by fluid pressure generated by a draft inducer fan. While principles of the present invention have been representatively incorporated in a fuel-fired water heater, those of skill in this particular art will readily appreciate that such principles may also be incorporated to advantage in other types of fuel-fired heating appliances such as, for example, boilers and furnaces.

The foregoing detailed description is to be clearly understood as being given by way of illustration and example only, the spirit and scope of the present invention being limited solely by the appended claims.

What is claimed is:

1. Heating apparatus comprising:

a fuel-fired heating appliance which, during firing thereof, discharges hot combustion gases through a flue;

a housing having an internal wall structure dividing its interior into first and second chambers communicating with one another through an opening in said internal wall structure, said first chamber having an inlet area communicating with said flue to receive hot combustion gases therefrom, said housing further having an outlet area through which the received hot combustion gases may exit said housing;

a draft inducer fan associated with said housing and operative to sequentially flow the received hot combustion gases from said first chamber through said internal wall structure opening into said second chamber and then outwardly from said housing through said outlet area; and a damper movable, by fluid pressure force created by operation of said draft inducer fan, from a normally closed position thereof in which said damper substantially prevents gas flow between said inlet and outlet areas, to an open position in which said damper permits gas flow between said inlet and outlet areas, said damper being a gravity damper pivotally carried within said housing for movement between said normally closed and open positions.

2. The heating apparatus of claim 1 wherein:

said fuel-fired heating appliance is a water heater.

3. The heating apparatus of claim 1 wherein:

said internal wall structure opening is an orifice opening sized and configured to control at least one operating parameter of said heating apparatus.

4. The heating apparatus of claim 1 wherein:

said draft inducer fan has an impeller portion with an inlet communicating with said second chamber.

5. The heating apparatus of claim 1 wherein:

said gravity damper, when in said normally closed position thereof, blockingly extends across at least one of said first and second chambers.

6. The heating apparatus of claim 1 wherein:

said gravity damper, when in said normally closed position thereof, blocks said opening in said internal wall structure.

7. The heating apparatus of claim 6 wherein:

said housing has a dilution air inlet for receiving dilution air from an external source thereof, and said internal wall structure is configured to permit the received dilution air to flow into said second chamber through said opening when said damper is in said open position thereof.

8. The heating apparatus of claim 7 wherein:

said draft inducer fan has a motor disposed in an interior portion of said housing and positioned to be impinged upon and cooled by incoming dilution air, said interior portion of said housing communicating with said first chamber.

9. The heating apparatus of claim 6 wherein:

said opening is a first opening, said internal wall structure further divides the interior of said housing into a third chamber separated from said first chamber and communicating with said second chamber through a second opening in said internal wall structure, said housing has a dilution air inlet through which dilution air from an external source thereof may flow into said third chamber for transfer therefrom into said second chamber via said second opening, and said damper blocks said first and second openings when said damper is in said normally closed position, and uncovers said first and second openings when said damper is in said open position thereof.

10. The heating apparatus of claim 9 wherein:

said draft inducer fan has a motor disposed within said third chamber and positioned to be impinged upon and cooled by incoming dilution air.

11. The heating apparatus of claim 1 wherein:

said draft inducer fan is operative to exert oppositely directed fluid pressure forces on said damper to move it from said normally closed position thereof to said open position thereof.

12. The heating apparatus of claim 1 further comprising:

damper stop structure operative to blockingly and sealingly engage said damper when said damper is in said normally closed position thereof.

13. Heating apparatus comprising:

a fuel-fired heating appliance which, during firing thereof, discharges hot combustion gases through a flue;

a housing having an internal wall structure dividing its interior into first and second chambers communicating with one another through an opening in said internal wall structure, said first chamber having an inlet area communicating with said flue to receive hot combustion gases therefrom, said housing further having an outlet area through which the received hot combustion gases may exit said housing;

a draft inducer fan associated with said housing and operative to sequentially flow the received hot combustion gases from said first chamber through said internal wall structure opening into said second chamber and then outwardly from said housing through said outlet area;

a damper movable, by fluid pressure force created by operation of said draft inducer fan, from a normally closed position thereof in which said damper substantially prevents gas flow between said inlet and outlet areas, to an open position in which said damper permits gas flow between said inlet and outlet areas;

damper stop structure operative to blockingly and sealingly engage said damper when said damper is in said normally closed position thereof; and sealing enhancement apparatus, connected to said damper, for forcing said damper against said damper stop structure when said damper is in said normally closed position thereof.

14. The heating apparatus of claim 13 wherein:

said sealing enhancement apparatus includes a motor coupled to said damper and operative to controllably drive said damper into forcible engagement with said damper stop structure during non-operative periods of said draft inducer fan.

15. The heating apparatus of claim 13 wherein:

said sealing enhancement apparatus includes a magnet carried by said damper.

16. The heating apparatus of claim 15 wherein:

said magnet is an electromagnet.

17. Heating apparatus comprising:

a fuel-fired heating appliance which, during firing thereof, discharges hot combustion gases through a flue;

a housing having an internal wall structure dividing its interior into first and second chambers communicating with one another through an opening in said internal wall structure, said first chamber having an inlet area communicating with said flue to receive hot combustion gases therefrom, said housing further having an outlet area through which the received hot combustion gases may exit said housing;

a draft inducer fan associated with said housing and operative to sequentially flow the received hot combustion gases from said first chamber through said internal wall structure opening into said second chamber and then outwardly from said housing through said outlet area;

a damper movable, by fluid pressure force created by operation of said draft inducer fan, from a normally closed position thereof in which said damper substantially prevents gas flow between said inlet and outlet areas, to an open position in which said damper permits gas flow between said inlet and outlet areas; and a plurality of pressure taps installed on said housing and operative to sense internal pressures therein which are indicative of a predetermined operating condition of said heating apparatus.

18. The heating apparatus of claim 17 wherein:

said operating condition is the operation of said draft inducer fan.

19. A draft inducer fan assembly comprising:

a housing having an inlet for receiving hot combustion gases discharged from a fuel-fired heating appliance during firing thereof, an outlet for discharging the received hot combustion gases, an internal wall structure dividing the interior of said housing into a first chamber opening outwardly through said inlet, and a second chamber opening outwardly through said outlet, said internal wall structure having an opening therein through which said first and second chambers communicate with one another;

a draft inducer fan having an impeller disposed within said housing and operative to flow hot combustion gases sequentially into said inlet, through said first chamber, through said internal wall structure opening into said second chamber, through said second chamber, and outwardly through said outlet; and a damper disposed within said housing and being movable between a normally closed position in which said damper substantially prevents fluid flow between said inlet and said outlet, and an open position in which said damper permits fluid flow between said inlet and said outlet, said damper being openable by fluid pressure forces generated by said impeller during operation of said draft inducer fan, said damper being a gravity damper pivotally carried within said housing for movement between said normally closed and open positions.

20. The draft inducer fan assembly of claim 19 wherein:

said damper, when in said normally closed position thereof, blockingly extends across at least one of said first and second chambers.

21. The draft inducer fan assembly of claim 19 wherein:

said damper, when in said normally closed position thereof, blocks said opening in said internal wall structure.

22. The draft inducer fan assembly of claim 21 wherein:

said housing has a dilution air inlet for receiving dilution air from an external source thereof, and said internal wall structure is configured to permit the received dilution air to flow into said second chamber through said opening when said damper is in said open position thereof.

23. The draft inducer fan assembly of claim 22 wherein:

said draft inducer blower has a motor disposed in said housing and positioned to be impinged upon and cooled by incoming dilution air.

24. The draft inducer fan assembly of claim 19 wherein:

said draft inducer fan is operative to exert oppositely directed fluid pressure forces on said damper to move it from said normally closed position thereof to said open position thereof.

25. A draft inducer fan assembly comprising:

a housing having an inlet for receiving hot combustion gases discharged from a fuel-fired heating appliance during firing thereof, an outlet for discharging the received hot combustion gases, an interior wall dividing the interior of said housing into a first chamber opening outwardly through said inlet, and a second chamber opening outwardly through said outlet, said interior wall having an opening therein through which said first and second chambers communicate with one another;

a draft inducer fan having an impeller disposed within said housing and operative to flow hot combustion gases sequentially into said inlet, through said first chamber, through said interior wall opening into said second chamber, through said second chamber, and outwardly through said outlet; and a damper disposed within said housing and being movable between a normally closed position in which said damper substantially prevents fluid flow between said inlet and said outlet, and an open position in which said damper permits fluid flow between said inlet and said outlet, said damper being openable by fluid pressure forces generated by said impeller during operation of said draft inducer fan, said damper, when in said normally closed position thereof, blocking said opening in said internal wall structure, wherein:

said opening is a first opening, said internal wall structure further divides the interior of said housing into a third chamber separated from said first chamber and communicating with said second chamber through a second opening in said internal wall structure, said housing has a dilution air inlet through which dilution air from an external source thereof may flow into said third chamber for transfer therefrom into said second chamber via said second opening, said damper blocks said first and second openings when said damper is in said open position thereof, and said draft inducer fan has a motor disposed within said third chamber and positioned to be impinged upon and cooled by incoming dilution air.

26. Heating apparatus comprising:

a draft inducer fan assembly for use with a fuel-fired heating appliance which, during firing thereof, discharges hot combustion gases through a flue, said draft inducer fan assembly including:

a housing having a first inlet for receiving the discharged combustion gases, a second inlet for receiving dilution air, and an outlet for discharging the received combustion gases and dilution air;

a draft inducer fan associated with said housing and operative to draw the combustion gases into said first inlet, draw the dilution air into said second inlet, and discharge the combustion gases and dilution air through said outlet, said draft inducer fan having a motor disposed in said housing for impingement and cooling by dilution air flowing therethrough; and a damper member disposed within said housing and movable, by fluid pressure created by operation of said draft inducer fan, from a normally closed position to an open position, said damper member being a gravity damper pivotally carried within said housing for movement between said normally closed and open positions, an internal wall portion of said housing cooperating with said damper member, when it is in said normally closed position during non-firing periods of said fuel-fired heating appliance, to substantially prevent convective flow of flue-heated air outwardly through either of said second inlet and said outlet.

27. The heating apparatus of claim 26 further comprising:

a fuel-fired heating appliance having a flue with an outlet portion coupled to said first inlet of said housing.

28. The heating apparatus of claim 27 wherein:

said fuel-fired heating appliance is a water heater.

* * * * *